US008613838B2

(12) United States Patent
Wallace et al.

(10) Patent No.: US 8,613,838 B2
(45) **Date of Patent: *Dec. 24, 2013**

(54) SYSTEM FOR MAKING A USABLE HYDROCARBON PRODUCT FROM USED OIL

(75) Inventors: Gregory Odell Wallace, Baytown, TX (US); John G. Schulz, Spring, TX (US); Benjamin P. Cowart, Houston, TX (US)

(73) Assignee: Vertex Energy, LP, Houston, TX (US)

( * ) Notice: Subject to any disclaimer, the term of this patent is extended or adjusted under 35 U.S.C. 154(b) by 818 days.

This patent is subject to a terminal disclaimer.

(21) Appl. No.: 12/845,522

(22) Filed: Jul. 28, 2010

(65) Prior Publication Data

US 2011/0024259 A1 Feb. 3, 2011

Related U.S. Application Data

(60) Provisional application No. 61/230,216, filed on Jul. 31, 2009.

(51) Int. Cl.
*C10G 17/06* (2006.01)

(52) U.S. Cl.
USPC .... 196/46.1; 196/46; 210/167.02; 210/195.1; 210/207; 700/271; 700/272

(58) Field of Classification Search
USPC ..... 196/46, 46.1; 208/179–181; 210/800, 210/805, 806, 134, 167.01, 167.02, 195.1, 210/198.1, 200, 205, 206, 207; 700/266, 700/271, 272
See application file for complete search history.

(56) References Cited

U.S. PATENT DOCUMENTS

| | | | | |
|---|---|---|---|---|
| 3,376,216 | A * | 4/1968 | Carlos et al. | 208/179 |
| 3,790,474 | A * | 2/1974 | Moffitt | 208/181 |
| 4,105,542 | A * | 8/1978 | Fainman | 208/180 |
| 4,272,359 | A * | 6/1981 | Owen | 208/179 |
| 4,502,948 | A * | 3/1985 | Tabler | 208/183 |
| 5,853,563 | A * | 12/1998 | Ripley et al. | 208/13 |
| 7,374,668 | B1 | 5/2008 | DiValentin et al. | |
| 7,976,699 | B2 * | 7/2011 | Kesler | 208/184 |
| 8,398,847 | B2 * | 3/2013 | Wallace et al. | 208/180 |
| 2004/0055677 | A1 | 3/2004 | Filippini et al. | |
| 2005/0214408 | A1 | 9/2005 | Pilkington et al. | |
| 2005/0255013 | A1 | 11/2005 | Teall et al. | |
| 2008/0045762 | A1 | 2/2008 | Foody et al. | |
| 2008/0282606 | A1 | 11/2008 | Plaza et al. | |
| 2009/0062581 | A1 | 3/2009 | Appel et al. | |

* cited by examiner

*Primary Examiner* — Nina Bhat
*Assistant Examiner* — Jonathan Miller
(74) *Attorney, Agent, or Firm* — Buskop Law Group, PC; Wendy Buskop

(57) ABSTRACT

One or more computer implemented systems for continuously processing used oils are provided. The system can include a feedstock tank containing feedstock. The feedstock tank can have a sparger and a level sensor. The feedstock tank can be in fluid communication with a first pump, a first filter, a heater, a second filter, first flow meter, a primary nozzle, a secondary nozzle, a motionless inline static mixer, and a first reactor.

11 Claims, 5 Drawing Sheets

SYSTEM FOR MAKING A USABLE HYDROCARBON PRODUCT FROM USED OIL

CROSS REFERENCE TO RELATED APPLICATIONS

The present application claims priority to U.S. Provisional Patent Application No. 61/230,216, which was filed Jul. 31, 2009, entitled "SYSTEM FOR MAKING A USABLE HYDROCARBON PRODUCT FROM USED OIL". The entirety of this reference is herein incorporated.

FIELD

The present embodiments generally relate to a system for making a usable refined hydrocarbon product from a used oil, such as a used marine oil, used diesel oil, contaminated crude oil, or a similar used hydrocarbon based product.

BACKGROUND

A need for exists a system to quickly process used oils, such as lube oils and diesel oils.

A need exists for a system to quickly process used oil which additionally is low in temperature and low in energy costs.

A need exists for a system that additionally processes used oil while reducing carbon emissions, also known as the "carbon footprint" as compared with currently available processes for treating used oil, which are mostly high temperature and high pressure, and are fundamentally dangerous.

A need exists for a continuously operational system having a continuous feed.

A need exists for a computer operated and implemented system that does not require a substantial amount of labor in the plant, thereby reducing the potential for accidents to human life.

The present embodiments meet these needs.

BRIEF DESCRIPTION OF THE DRAWINGS

The detailed description will be better understood in conjunction with the accompanying drawings as follows.

Figure 1A:
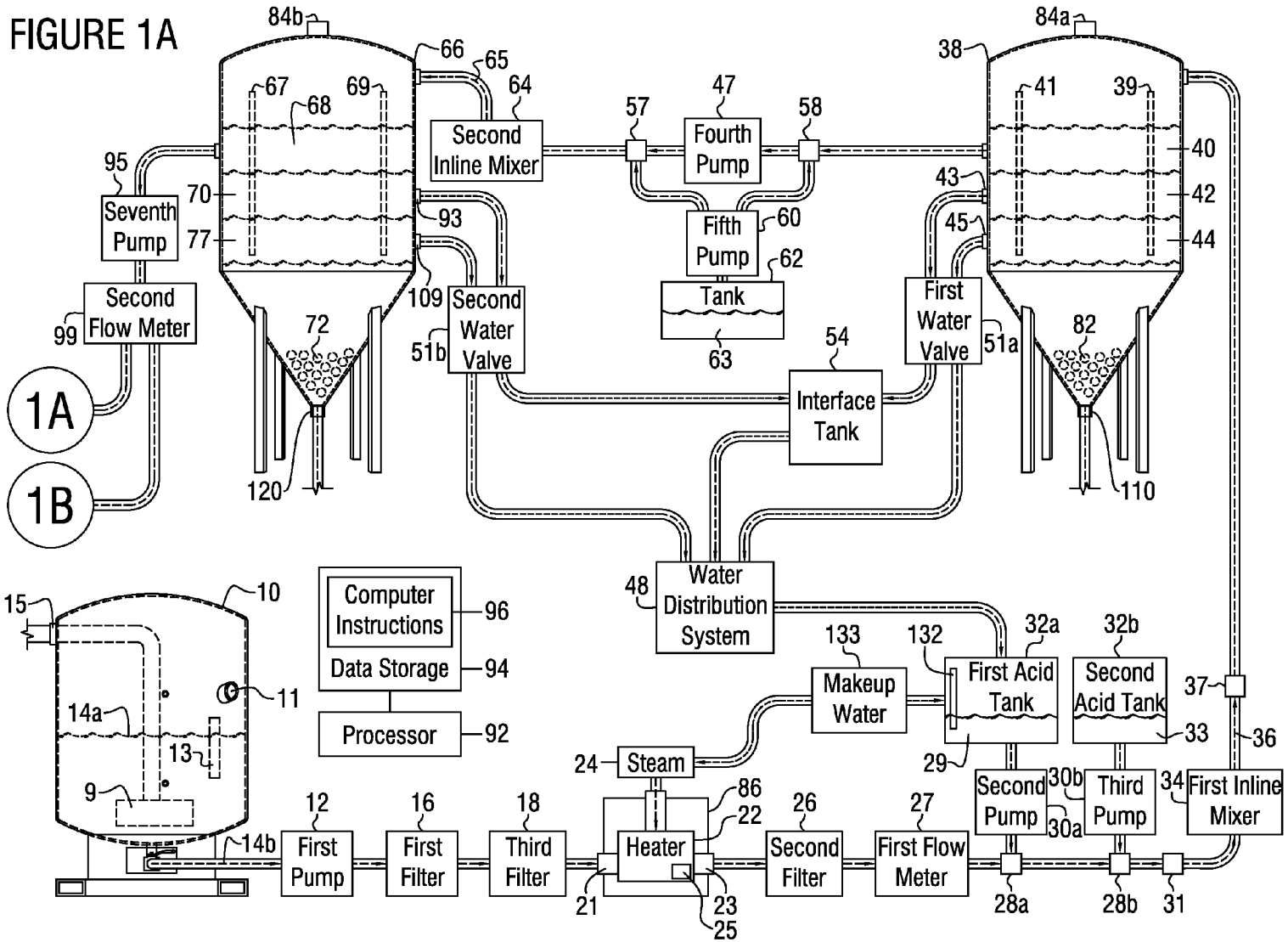
FIGS. 1A-1B depict a schematic of an illustrative system.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The present embodiments generally relate to a computer implemented system for processing used oils into a usable substance.

An illustrative system can include a feedstock tank that can store or contain feedstock. The feedstock can be lube oil, diesel oil, vacuum gas oil (VGO), contaminated crude oil or another hydrocarbon waste product.

The feedstock tank can have a sparger. The sparger can be disposed within the feedstock tank and can be used to mix the feedstock within the feedstock tank. The feedstock tank can also include a level sensor. The level sensor can be disposed within the feedstock tank. The level sensor can monitor the level of the feedstock within the feedstock tank. In one or more embodiments, the level sensor can continuously monitor the level of feedstock in the feedstock tank.

An outlet of the feedstock tank can be in fluid communication with a first pump. The first pump can be a positive displacement pump, such as a gear pump. The first pump can be operated to provide a flow rate of the feedstock from the feedstock tank of about 250 gallons per minute (gpm).

A first filter can be disposed within the system downstream of the feedstock tank. The filter can be in fluid communication with the first pump. The first filter can filter the feedstock and retain 400 micron particulate to 800 micron particulate. In one or more embodiments, the first filter can have at least two stages. Both stages can filter particulate of at least 400 microns.

A heater can be disposed downstream of the first filter. The heater can be in fluid communication with the first filter. The heater can heat feedstock that has been filtered by the first filter. In one or more embodiments, the heater can receive steam and can transfer heat from the steam to the filtered feedstock. The heater can be configured to heat the filtered feedstock to a temperature of at least 160 degrees Fahrenheit. In one or more embodiments, the heater can heat the filtered feedstock to a temperature of about 160 degrees Fahrenheit, 180 degrees Fahrenheit, 190 degrees Fahrenheit, 200 degrees Fahrenheit, or 215 degrees Fahrenheit.

In one or more embodiments, a shell and tube heat exchanger can be used as the heater. The heat exchanger can operate at temperatures from about 175 degrees Fahrenheit to about 215 degrees Fahrenheit on the feedstock stream side. The heat exchanger can have multiple passes on the tube side, such as a 6 pass tube exchanger. The heater can be any heat exchanger capable of transferring heat from one medium to the filtered feedstock.

The heater can use steam supplied by a boiler. Water can be supplied from a water source. For example, a water source, such as a well, river, or supply, can provide water at 30 psig through a 2 inch line to the boiler. The normal operating pressure of the line can run about 150 psig. Hoses and or piping to the heater from the boiler can be about 3 inches. The condensate return line can flow water back from the heater to the boiler.

The capacity of the heater can be from about 1 million BTU to about 4 million BTU per hour based on a flow rate of 70 gallons per minute of fluid being processed. The heater can have a pressure of from about 100 psig to about 150 psig.

A second filter can be disposed within the system downstream of the heater. The second filter can receive heated feedstock from the heater and can filter the heated feedstock. The second filter can remove and retain from about 100 micron to about 400 micron particulate from the heated feedstock.

In one or more embodiments, a third filter can be disposed between the first filter and the heater. The second filter can remove and retain 400 micron particulate to 800 micron particulate from the feedstock.

The system can also include a first flow meter downstream of the second filter for measuring the flow rate of the feedstock within the system. The flow meter can be a Micro-Motion™ flow meter or another commercially available flow meter.

The system can also include a primary nozzle. The primary nozzle can be downstream of the first flow meter. The primary nozzle can inject an aqueous sulfuric acid into the feedstock. The aqueous sulfuric acid can be stored in a tank and a pump can be used to transfer the aqueous sulfuric acid from the tank into the primary nozzle. The primary nozzle can inject the aqueous sulfuric acid into the heated feedstock. The aqueous sulfuric acid can be injected at a ratio of about 0.15 to 0.20 (or 15% to 20%) gallons per gallon of feedstock. The aqueous sulfuric acid can be in fluid communication with a water source, such as a water distribution system, a well, a river, or combinations thereof. For example, a water source can provide "makeup water" to the first acid tank, and a level controller can be used to control the level of fluid in the first acid tank. The makeup water can be provided by other sources.

A secondary nozzle can be disposed in the system downstream of the primary nozzle. The secondary nozzle can inject a concentrated sulfuric acid into the feedstock. The concentrated sulfuric acid can be stored in a second acid tank and a pump can transfer the concentrated sulfuric acid from the second acid tank to the secondary nozzle. The secondary nozzle can inject the concentrated sulfuric acid into the heated feedstock at a ratio of from about 2 gallons per 1000 gallons of feedstock to about 4 gallons per 1000 gallons of feedstock.

A first inline static mixer can be disposed in the system downstream of the secondary nozzle. The inline static mixer can have one or more fins. The inline static mixer can mix the feedstock to ensure that the acids are fully integrated with the feedstock stream. Accordingly, a mixed stream can be exported from the first inline static mixer. In one or more embodiments, the first inline static mixer can create a bubble-free high velocity mixed stream. In one or more embodiments, the pressure drop across the inline static mixer can be 3 psi or less.

The first inline static mixer can be in fluid communication with a first reactor. The first reactor can be downstream of the first inline static mixer. The first reactor can receive the mixed stream from the first inline static mixer. The first reactor can enable the mixed stream to be separated into a first water layer, a first interface layer, an intermediate oil product layer, and a first bottoms layer. The feedstock and other fluids within the mixed stream can react with or otherwise be influenced by the aqueous sulfuric acid and the concentrated sulfuric acid. These reactions, which would be obvious to one skilled in the art with the aid of this disclosure, cause the phases to separate in the reactor. The reactions can require certain residence times or process conditions in order to fully occur. The residence times can be determined by one skilled in the art with the aid of the disclosure without undue experimentation. The process conditions, such as temperature and pressure, can be determined by one skilled in the art with the aid of the disclosure without undue experimentation.

The intermediate oil product layer can be in fluid communication with a fourth pump. A fifth pump can be in fluid communication with an solvent release agent nozzle. The solvent release agent nozzle can be adapted to provide an solvent release agent to the first intermediate oil product layer. For example, the solvent release agent can be stored in a tank, and a pump can provide the solvent release agent from the tank to the solvent release agent nozzle. The aromatic solvent release agent can be injected at a ratio of from about 4 gallons per 1000 gallons of feedstock to about 7 gallons per 1000 gallons of feedstock. The solvent release agent can be injected into the intermediate oil product upstream or down stream of the fourth pump.

The solvent release agent can be or include alcohols, ketones, esters, aliphatic solvents, aromatic solvents, detergents or derivatives thereof or combinations.

A second inline static mixer can be disposed within the system and in fluid communication with the fourth pump. The second inline static mixer can be adapted to blend the aromatic solvent release agent with the first intermediate oil product layer to form a blended product.

The second inline static mixer can be in fluid communication with a second reactor. The blended product can separate into a second bottoms layer, a second water layer, a second interface layer, and a finished oil product.

A water distribution system can be in fluid communication with the first water layer in the first reactor and the second water layer in the second reactor. One or more pumps and flow control devices can facilitate and control the transportation of the first water layer from the first reactor and the second water layer from the second reactor to the water distribution system. The water distribution system can provide water to one or more components of the system. For example, the water distribution system can provide water to the first acid tank, to a disposal area, and can also provide water to other portions of the system.

An interface tank can be in fluid communication with the first interface layer in the first reactor and the second interface layer in the second reactor. One or more pumps and flow control devices can facilitate and control the flow of the first interface layer from the first reactor to the interface tank and the flow of the second interface layer to the interface tank.

The system can also have a disposal in fluid communication with the first bottoms layer in the first reactor and the second bottoms layer in the second reactor. One or more pumps and flow control devices can facilitate and control the flow of the first bottoms layer from the first reactor and the second bottoms layer from the second reactor to the disposal.

In one or more embodiments, a single pump, such as the eleventh pump, can facilitate the flow of the bottoms layer to the disposal, the interface layers to the interface tank, and the water layers to the water distribution system. The eleventh pump can also facilitate the transfer of water from the interface tank to the water distribution system.

In one or more embodiments, a first water valve can control the flow of the water layer from the first reactor, and a second water valve can control the flow of water from the second reactor.

A seventh pump can be in fluid communication with the finished oil product and a second flow meter.

The system can include a processor. The processor can send and receive signals from various components of the system. For example, the processor can receive signals from the flow meters, level sensors, and water valves. The processor can compare data acquired from the signals to preset values stored in an associated data storage. The processor can control, monitor, or both control and monitor the pumps, water valves, and other components of the system. For example, the processor can monitor the size of the flow area through the water valves.

A first settling vessel can be in fluid communication with the second reactor. The first settling vessel can be in parallel with the second settling vessel. The first settling vessel and the second settling vessel can be in fluid communication with a ninth pump. Accordingly, the first settling vessel can receive the finished oil product from the second flow meter. The first settling vessel can allow the finished oil product to separate into a high water particulate oil stream and a finished product. The finished product is a usable form of the feedstock utilized.

A second settling vessel can be in fluid communication with the second reactor. The second settling vessel can be in parallel with the first settling vessel. The second settling vessel can also receive the finished oil product from the second flow meter. The second settling vessel can allow the finished oil product to settle into a high water particulate oil stream and a finished product. The finished product is a usable form of the feedstock utilized.

An eighth pump can be in fluid communication with the high water particulate oil streams and a waste water tank. The finished product can be in fluid communication with a finished product tank. One or more pumps can be used to pump the finished product to the finished product tank. In one or more embodiments, the eighth pump can be used to pump the finished product to the finished product tank and the high water particulate oil streams to the waste water tank.

Each of the settling vessels can have level sensors. The level sensors can be in communication with the processor. The processor can compare data acquired from the level sensors to preset limits. The processor can shut down one or more of the pumps in the system when the acquired data exceeds the preset limits.

In one or more embodiments, the processor can be in communication with a network. The network can provide information to a web-server. The network can also communicate with one or more client devices. The client devices can be monitored or viewed by an operator.

An operator can be a person or computer responsible for monitoring the entire process and providing an alarm to other persons or computers when non compliance occurs.

The data storage associated with the processor can include computer instructions to instruct the processor to regulate and assist in the operation of the method; computer instructions for instructing the processor to monitor and receive data from a connected device of the process; computer instructions for instructing the processor to compare the received data to preset limits in the data storage; computer instructions for instructing the processor to ensure contact with a web server, user client device or combinations thereof; computer instructions for instructing the processor to provide a notification to an operator with a display associated with the processor, an operator with a client device connected to a network, or combinations thereof, wherein the received data exceeds or is less than preset limits; computer instructions for instructing the processor to initiate one or more of a sequence of steps to shut down one or more devices monitoring by the connected devices when the received signals exceed or are less than preset limits; computer instructions for instructing the processor to continuously update a user client device with received data from one or more of the connected devices; computer instructions for instructing the processor to provide a notification when the processor becomes disconnected from one or more of the connected devices, wherein the notification is provided to a display connected to the processor, to a client device of a user connected through a network, or combinations thereof; computer instructions to instruct the processor to generate a report on request concerning the status of the connected device, the overall method employed by the method, or combinations thereof; and computer instructions for continuing to run the computer from an uninterrupted power supply to shut down each pump and heater of the process and close or open associated valves as required for safety of the process.

Accordingly, one or more embodiments of the systems disclosed herein can be used to create a chemical process that utilizes a chemical reaction to form products from the reactions. The system can also be used to separate the formed products.

The systems disclosed herein do not require complex equipment. In addition, the systems disclosed herein can be operated at low temperatures and pressures.

Embodiments of the system disclosed herein can use individual components or equipment that do not require large plot areas. Accordingly, the systems disclosed herein can be compact.

Furthermore, embodiments of the disclosed systems can be monitored from a remote location, and the systems can be operated unattended due to automation of one or more components of the systems.

Embodiments of the system disclosed herein can allow for the clean up and recycling of waste crude oil streams, and can prevent environmental and safety issues from occurring.

Embodiments of the disclosed system can also be used to recycle used motor oil, contaminated crude oil, other contaminated oils, or contaminated hydrocarbon products, and keep used or contaminated oil from rivers, streams, or lakes. Embodiments can also be used to keep oil out of ground water supplies, which can affect drinking water. In addition, recycling used or contaminated hydrocarbon products can save energy and a valuable resource.

One or more embodiments of the system can also be used to re-refine used motor oil or other contaminated hydrocarbons into base stock. The base stock can be used as lubricating oil. Accordingly, the amount of crude oil used as lubricating oil can be reduced.

In addition, the product created by one or more embodiments of the system can be used to produce power. For example, two gallons of finished product can be used to generate electricity to run the average household for almost 24 hours.

The product created by one or more embodiments of the system can be used in an industrial fuel. For example, large industrial boilers can efficiently burn the finished product with minimum pollution. Accordingly, the product can be used to power plants or cement kilns.

Furthermore, one or more embodiments of the system can be used to clean up environmental objectionable and accidental discharges. For example, the accidentally discharged hydrocarbon can be recovered and recycled.

Figure 1B:
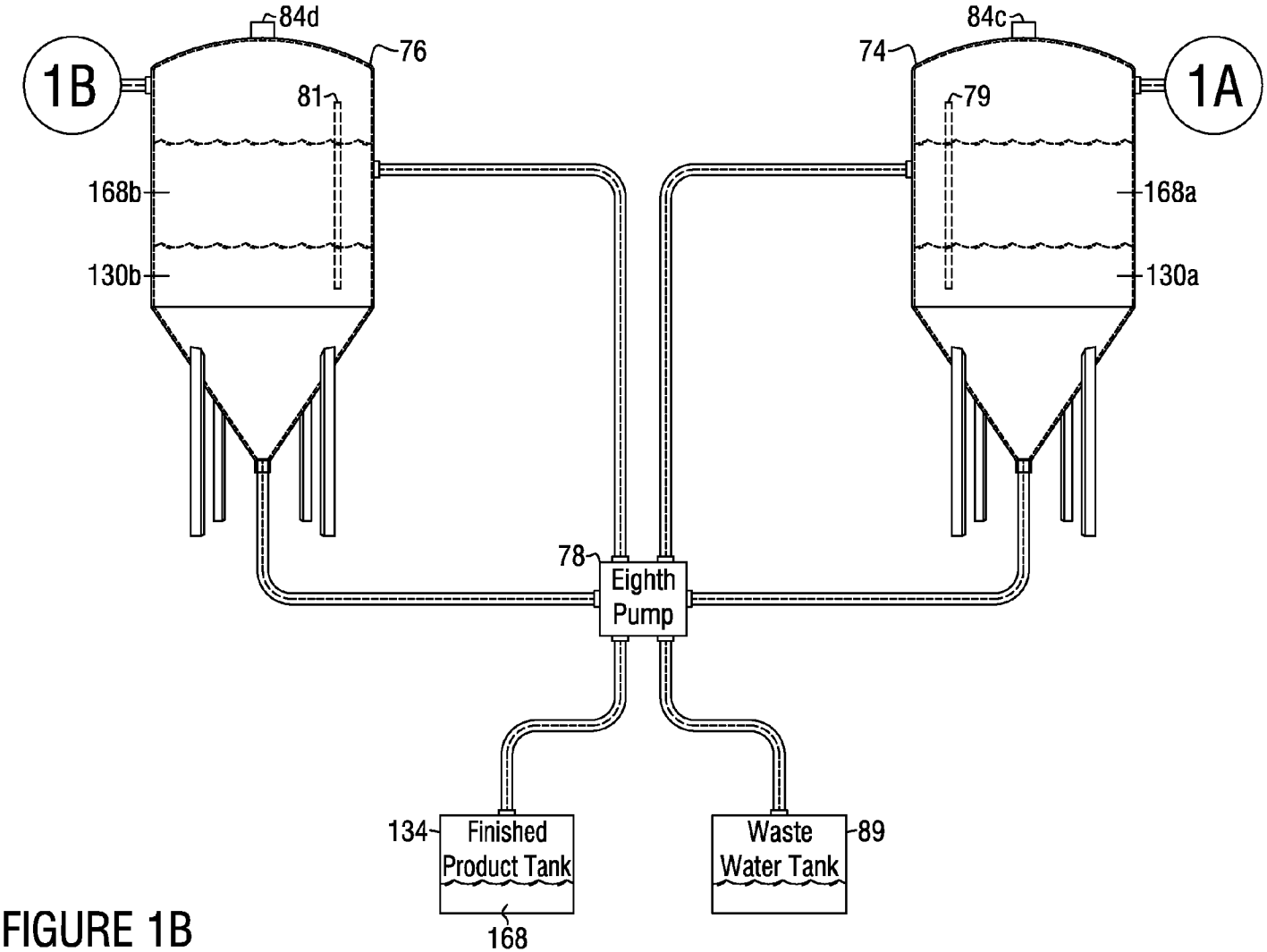

Turning now to the Figures, FIG. 1A depicts a schematic of an illustrative system. FIG. 1B is a continuation of FIG. 1A. Referring to both FIGS. 1A and 1B, the system can include a feedstock tank 10, a first pump 12, a first filter 16, a third filter 18, a heater 22, a second filter 26, a first flow meter 27, a first inline mixer 34, a first reactor 38, a first water valve 51*a*, a water distribution system 48, an interface tank 54, a second water valve 51*b*, a second inline mixer 64, a fourth pump 47, a tank 62, a fifth pump 60, a second reactor 66, a seventh pump 95, a second flow meter 99, a first settling vessel 74, a second settling vessel 76, an eighth pump 78, a finished product tank 134, and a waste water tank 89.

The feedstock tank 10 can have an inlet valve 15. The inlet valve 15 can be configured to allow feedstock 14*a* to be pumped or otherwise provided to the feedstock tank 10. A sparging device 9 can be connected to the inlet 15. A level sensor 13 can be disposed within the feedstock tank 10. The level sensor 13 can detect the level of feedstock 14*a* within the feedstock tank 10. The feedstock tank 10 can also have a testing port 11. The testing port 11 can be configured to receive one or more measurement devices, have a viewing window, allow a sample of the feedstock 14*a* to be removed from the feedstock tank 10, or combinations thereof.

A feedstock stream 14*b* can be discharged from the feedstock tank 10. For example, the first pump 12 can be operated to provide pump head to the feedstock stream 14*b* to provide a desired flow rate of the feedstock stream 14*b* through at least a portion of the system.

The first pump 12 can be in fluid communication with the first filter 16. The first filter 16 can filter at least a portion of the feedstock stream 14*b*. The third filter 18 can be disposed in the system adjacent the first filter 16, or can be a second stage of the first filter 16. The first filter 16 can have one or more stages.

The heater 22 can be disposed within the system adjacent the third filter 18. The heater 22 can have an inlet 21 and an outlet 23. The heater 22 can also be disposed within an insulation 86. A steam 24 can be provided to the heater 22. A pressure indicator and controller 25 can monitor steam pressure in the heater 22.

The second filter 26 can be disposed adjacent the outlet 23 of the heater 22. The second filter 26 can filter feedstock being discharged from the outlet 23.

The first flow meter 27 can be adjacent the second filter 26, or otherwise located in the system, to measure the flow rate of the feedstock stream 14*b* in at least a portion of the system.

The first inline mixer 34, also referred to as a first inline static mixer, can be disposed within the system adjacent to a secondary nozzle 28*b*. The first inline mixer 34 can mix or blend a concentrated sulfuric acid 33 and an aqueous sulfuric acid 29 into the feedstock stream 14*b*.

The aqueous sulfuric acid 29 can be stored in a first acid tank 32*a*. The first acid tank 32*a* can receive makeup water 133. The amount of makeup water 133 supplied to the first acid tank 32*a* can be controlled by a level controller 132. The second pump 30*a* can be connected to or in fluid communication with a primary nozzle 28*a* for injecting the aqueous sulfuric acid 29 into the feedstock stream 14*b*.

The concentrated sulfuric acid 33 can be disposed within a second acid tank 32*b*. The concentrated sulfuric acid 33 can be in fluid communication with a third pump 30*b*. The third pump 30*b* can be connected to or in fluid communication with the secondary nozzle 28*b* for injecting the concentrated sulfuric acid 33 into the feedstock stream 14*b*.

The system can have one or more pressure monitors. For example, a pressure monitor 31 can be disposed within the system between the secondary nozzle 28*b* and the first inline mixer 34.

The system can also have one or more temperature sensors or gauges, generally referred to as sensor indicators. For example, a temperature indicator 37 can be disposed within the system adjacent the first inline mixer 34.

The first inline mixer 34 can be in fluid communication with the first reactor 38. The first reactor 38 can include one or more level sensors, such as level sensors 39 and 41. The first reactor 38 can also include a first relief valve 84*a*. The first reactor 38 can have four outlets. The first outlet can be in fluid communication with the fourth pump 47. The first reactor 38 can have a second outlet 43, also referred to as a first interface port, and a third outlet 45, also referred to as a first water port. The first reactor 38 can also have a fourth outlet 110, also referred to as a first bottom outlet, which can be used to discharge bottoms from the first reactor 38.

The first water valve 51*a* can be in fluid communication with the first water port 45 and the water distribution system 48. The water distribution system 48 can be in fluid communication with the interface tank 54.

The water distribution system 48 can receive water from one or more components of the system and can provide water to one or more components of the system, waste disposal, or combinations thereof.

The fourth pump 47 can also be in fluid communication with the second inline mixer 64, also referred to as a second inline static mixer.

An aromatic solvent release agent 63 can be stored in the tank 62. The tank 62 can be in fluid communication with the fifth pump 60, and the fifth pump 60 can be in fluid communication with at least one of a first injection nozzle 57 and a second injection nozzle 58. One or both of the injection nozzles 57 and 58 can inject the aromatic solvent release agent 63 into an intermediate oil product 40 discharged from the first reactor 38 via the first outlet of the first reactor.

The second inline mixer 64 can blend the aromatic solvent release agent 63 with the intermediate oil product 40. An outlet of the second inline mixer 64 can be in fluid communication with the second reactor 66.

The second reactor 66 can have a second pressure relief valve 84*b*. The second reactor 66 can also have one or more level sensors, such as level sensors 67 and 69. The second reactor 66 can have four outlets. For example the second reactor 66 can have a first outlet in fluid communication with a seventh pump 95; a second outlet 93, also referred to as a second interface port, in fluid communication with the interface tank 54; a third outlet 109, also referred to as a second water port, in fluid communication with the water distribution system 48, such as through the second water valve 51*b*; and a fourth outlet 120, also referred to as a second bottoms outlet, for discharging bottoms from the second reactor 66.

The second water valve 51*b* can be disposed between the water distribution system 48 and the second reactor 66.

The seventh pump 95 can be in fluid communication with the second flow meter 99. The second flow meter 99 can be in fluid communication with the first settling vessel 74 and the second settling vessel 76. The first settling vessel 74 can be in arranged in a parallel arrangement with the settling vessel 76.

The first settling vessel 74 can include one or more level sensors, such as level sensor 79, and a third pressure relief valve 84*c*. The second settling vessel 76 can include a fourth pressure relief valve 84*d* and one or more level sensors, such as level sensor 81.

The eighth pump 78 can be in fluid communication with both of the settling vessels 76 and 74.

The finished product tank 134 can be in fluid communication with the settling vessels 74 and 76. The waste water tank 89 can be in fluid communication with the settling vessels 74 and 76.

The system, and the methods of operating the system, can be used to run a profitable enterprise to produce a finished product, such as oil for both combustion and blending components for Diesel engines.

In operation, the feedstock 14*a* can be provided to the feedstock tank 10 via the inlet 15. For example, the feedstock tank 10 can be located on or in a facility configured to receive or unload the feedstock to be processed. The facility can be a truck unloading facility, a rail car unloading facility, a pipeline receiving station, or a Marine Terminal.

The feedstock 14*a* can be discharged from the feedstock tank 10 as a feedstock stream 14*b*. The first pump 12 can provide the pump head to form the feedstock stream 14*b* and to control the flow rate of the feedstock stream 14*b*.

The feedstock stream 14*b* can pass through the first filter 16 and the second filter 18 and particulates can be filtered out of the feedstock stream 14*b*. The feedstock stream 14*b* can then be heated by the heater 22.

After the feedstock stream 14*b* is heated, it can be discharged from the heater 22 and further filtered by the second filter 26. The first flow meter 27 can acquire data related to the flow rate of the feedstock stream 14*b* and transmit the data to a processor 92. The processor 92 can be in communication with a data storage 94, which can have computer instructions 96 stored thereon for comparing transferred data to preset limits and for controlling one or more components of the system.

The primary nozzle 28*a* can inject aqueous sulfuric acid 29 into the feedstock stream 14*b*. The aqueous sulfuric acid 29 can be provided to the primary nozzle 28*a* at a flow rate controlled by the second pump 30*a*. The level controller 132 can control flow of water, such as makeup water 133, into the first acid tank 32*a* to maintain a proper fluid level in the first acid tank 32*a*.

The secondary nozzle 28*b* can provide concentrated sulfuric acid 33 to the feedstock stream 14*b*. The third pump 30*b* can control the flow rate of the concentrated sulfuric acid 33.

The first inline mixer 34 can receive the feedstock stream 14*b* with the concentrated sulfuric acid 33 and the aqueous sulfuric acid 29. The first inline mixer 34 can blend the feedstock stream 14*b* with the concentrated sulfuric acid 33 and the aqueous sulfuric acid 29 to form a mixed stream 36. The temperature indicator 37 can acquire data related to the temperature of the mixed stream 36. The temperature indicator 37 can relay this acquired data back to the processor 92.

The mixed stream 36 can enter the first reactor 38. The level sensors 41 and 39 can acquire data related to the depth of the mixed stream 36 in the first reactor 38. The level sensors 41 and 39 can transmit the acquired data to the processor 92. The mixed stream 36 can be separated into the intermediate oil product 40, a first interface layer 42, a first water layer 44, and a first bottoms layer 82.

The intermediate oil product 40 can be discharged from the first reactor via the first outlet. The flow rate of the intermediate oil product 40 can be controlled by the fourth pump 47. The first injection nozzle 57, the second injection nozzle 58, or both can inject the aromatic solvent release agent 63 into the intermediate oil product 40. The fifth pump 60 can control the flow rate of the aromatic solvent release agent 63.

The intermediate oil product 40 with the aromatic solvent release agent 63 can flow to the second inline mixer 64. The second inline mixer 64 can blend the intermediate oil product 40 with the aromatic solvent release agent 63 to form blended product 65.

The blended product 65 can enter the second reactor 66. The level sensors 67 and 69 can acquire data related to the level of the blended product 65 and transmit the data to the processor 92. The blended product 65 can separate into a finished oil product 68, a second interface layer 70, a second water layer 77, and a second bottom layer 72.

The finished oil product 68 can be discharged from the first outlet of the second reactor 66. The seventh pump 95 can control the flow rate of the finished oil product out of the second reactor 66. The second flow meter 99 can acquire data related to the flow rate of the finished oil product 68 and transmit the data to the processor.

The finished oil product 68 can be provided to the first settling vessel 74, the second settling vessel 76, or both. The level sensor 81 can acquire data related to the depth of the finished oil product 68 in the second settling vessel 76, and the level sensor 79 can acquire data related to the depth of the finished oil product 68 in the first settling vessel 74.

The finished oil product 68 can be separated into finished product 168*a* and 168*b* and waste water 130*a* and 130*b* in the settling vessels 74 and 76. The finished product 168*a* and 168*b* can be discharged from the settling vessels 74 and 76 and provided to the finished product tank 134. The eighth pump 78 can control the flow rate of the finished product 168*a* and 168*b* out of the settling vessels 74 and 76. The waste water 130*a* and 130*b* can be discharged from the settling vessels 74 and 76 to the waste water tank 89. The eighth pump 78 can also control the flow rate of the waste water out of the settling vessels 74 and 76.

The finished product can be loaded onto a truck, train, water vessel, or other transportation device. For example, the finished product tank 134 can be in communication with a similar facility configured to allow the finished product to be loaded onto a transportation vessel or into a pipeline and transported to an end used or buyer.

The individual components of the system and the entire system can be configured and designed to meet all municipal codes, state codes, federal codes that relate to safety, operational integrity, and process control.

The waste products, for example, the waste in the disposal tank, the bottoms layers from the reactors and other waste products, can be disposed of according to environmental standards, recycled, or used in other ways.

Figure 2:
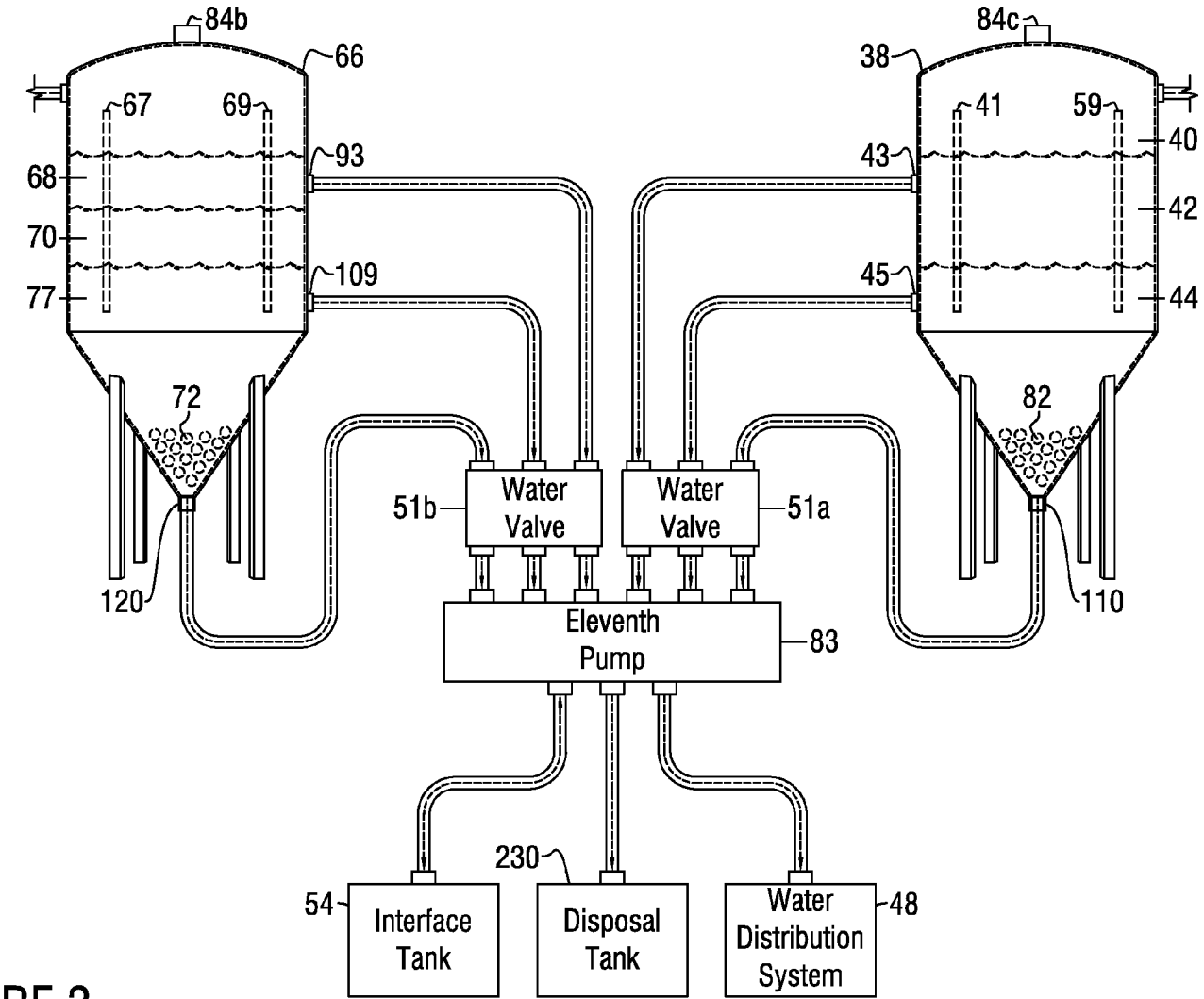
FIG. 2 depicts an illustrative schematic of a pumping arrangement for removing water layers, interface layers, and bottoms from a first reactor and a second reactor according to one or more embodiments.

FIG. 2 depicts an illustrative schematic of a pumping arrangement for removing the water layers 77 and 44, interface layers 42 and 70, and bottoms layers 82 and 72 from the first reactor 38 and the second reactor 66 according to one or more embodiments.

The first interface layer 42 can be discharged from the first reactor 38 via the first interface port 43. The first water layer 44 can be discharge from the first reactor 38 via the first water port 45. The first bottoms layer 82 can be discharged from the first reactor 38 via the first bottoms outlet 110.

The second interface layer 70 can be discharged from the second reactor 66 via the second interface port 93. The second water layer 77 can be discharged from the second reactor 66 via the second water port 109. The second bottoms layer 72 can be discharged from the second reactor 66 via the second bottoms outlet 120.

An eleventh pump 83 can control the flow rate of the water layers 77 and 44, interface layers 43 and 70, and bottoms layers 82 and 72 out of the reactors 38 and 66. The eleventh pump 83 can be in bi-directional communication with the interface tank 54. The eleventh pump 83 can also be in fluid communication with a disposal tank 230 and the water distribution system 48. The disposal tank 230 can be a truck or other disposal device or vessel.

The interface layers 43 and 70 can be provided to the interface tank 54. The water layers 77 and 44 can be provided to the water distribution system 48. The bottoms layers 82 and 72 can be provided to the disposal tank 230.

Water that can form in the interface tank 54 can also be transferred from the interface tank 54 to the water distribution system 48 via the eleventh pump 83.

The water valves 51*a* and 51*b* can control the flow of the layers 42, 44, 82, 70, 77, and 72 from the rectors 38 and 66. For example, the level sensors 67, 69, 41, and 59 can measure the level of the fluids in the reactors 38 and 66 and flow areas through the water valves 51*a* and 51*b* can be adjusted to maintain the fluid levels in the reactors 38 and 66 at a preset level.

The pressure relief valves 84*b* and 84*c* can be configured to release pressure from the reactors 66 and 38 if the pressure within the reactors 66 and 38 surpass a preset limit.

Figure 3:
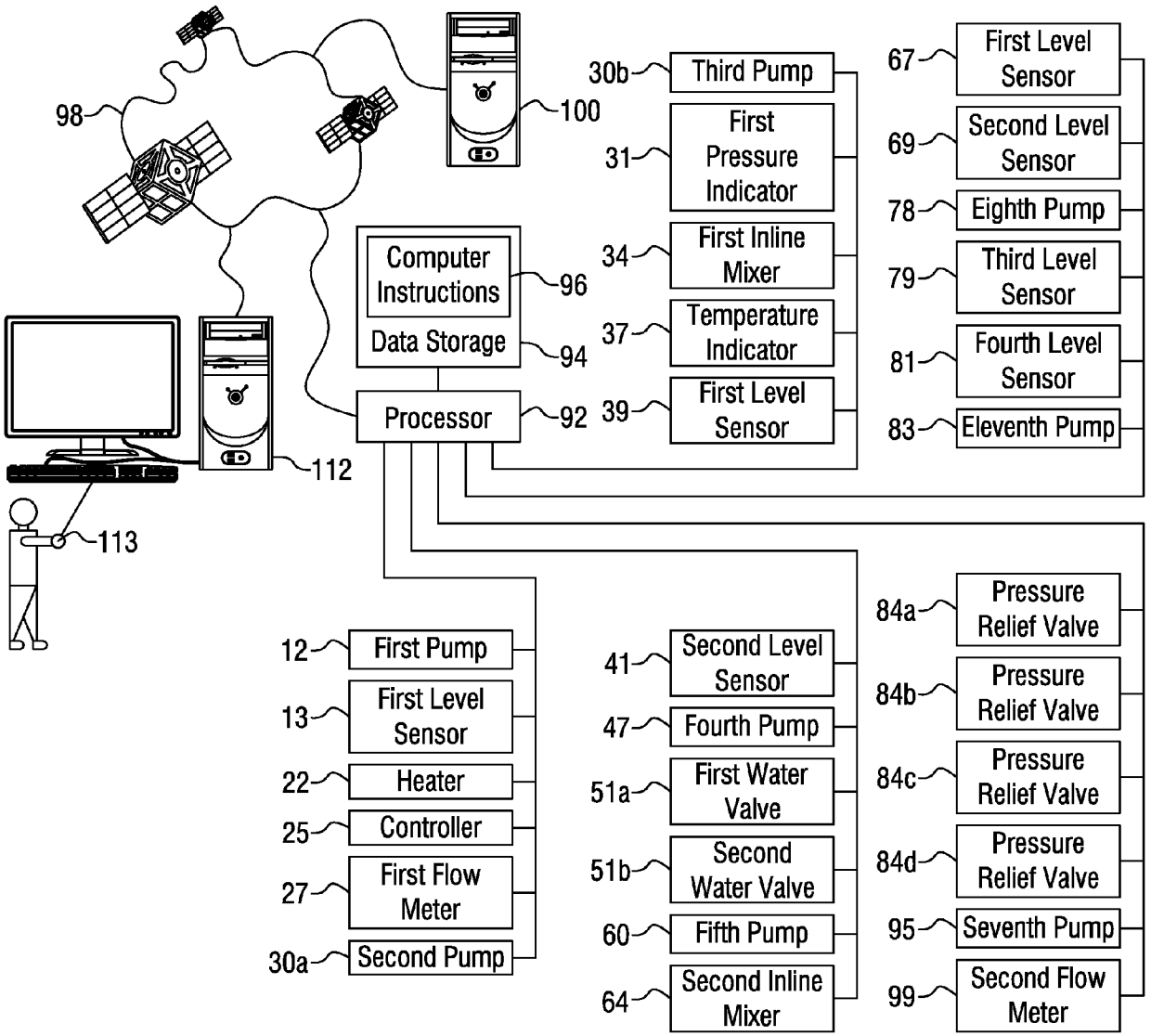
FIG. 3 depicts illustrative communication between a processor and various pieces of computer operable equipment of the system.

FIG. 3 depicts illustrative communication between a processor and various pieces of computer operable equipment of the system. The processor 92 can be in communication with a network 98. The network 98 can also be in communication with a server 100 and a client device 112. The client device 112 can be remote from the system. An operator 113 can view or otherwise interact with the client device 112. For example, the processor 92 can send reports to the client device 112 related to the system, a component of the system, a portion of the system, or a combination thereof, and the operator 113 can remotely monitor the system or components of the system. In addition, the operator 113 can use the client device 112 to control one or more operations of the system.

The processor 92 can acquire data from one or more of: the first pump 12, the second pump 30*a*, the third pump 30*b*, the first pressure indicator 31, the first inline mixer 34, the temperature indicator 37, the level sensors 13, 39, 41, 67, 69, 79, and 81, the controller 25, the heater 22, the first flow meter 27, the water valves 51*a* and 51*b*, the fourth pump 47, the fifth pump 60, the pressure relief valves 84*a*, 84*b*, 84*c*, and 84*d*, the second inline mixer 64, the eleventh pump 83, the seventh pump 95, the second flow meter 99, the eighth pump 78, or combinations thereof.

For example, the level sensors 67 and 69 can transmit data to the associated settling vessel and the processor can compare that data to preset limits stored in the data storage 94. The processor 92 can then stop, slow down, or speed up the seventh pump 95 to control the level of fluid in the second reactor preventing overflow of the settling vessel.

In another example, the processor 92 can acquire data from the water valves 51*a* and 51*b* to monitor the size of the flow area through the water valves 51*a* and 51*b*. The flow area through the water valves 51*a* and 51*b* can be controlled manually or automatically by the processor 92.

The processor 92 can be configured to control one or more components of the system based on acquired data and preset limits.

Figure 4:
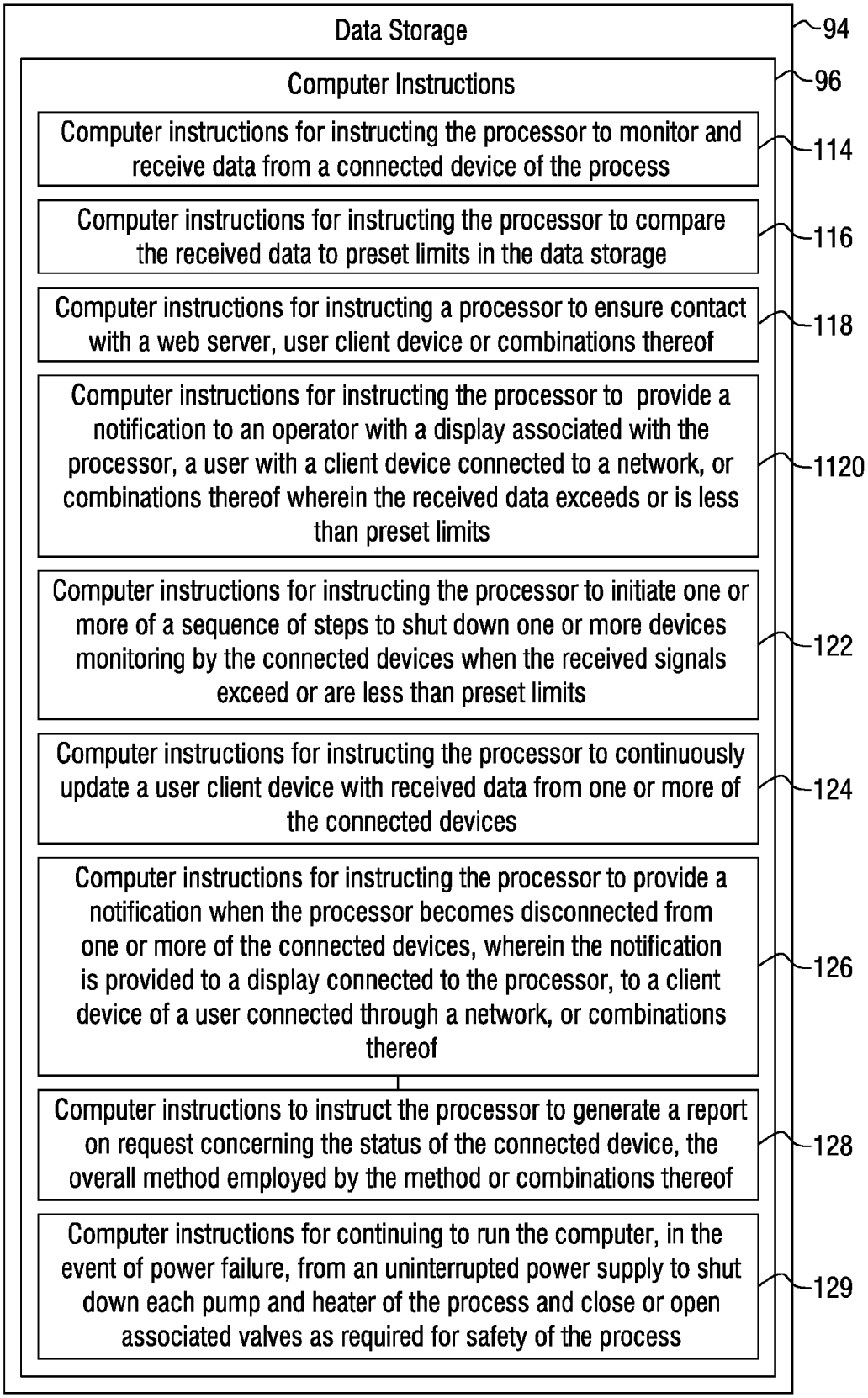
FIG. 4 depicts a diagram of an illustrative data storage with computer instructions used to operate at least a portion of the system.

FIG. 4 depicts a diagram of an illustrative data storage with computer instructions used to operate at least a portion of the system.

The data storage 94 can have computer instructions 96. The computer instructions 96 can include: computer instructions for instructing the processor to monitor and receive data from a connected device of the process 114; computer instructions for instructing the processor to compare the received data to preset limits in the data storage 116; computer instructions for instructing the processor to ensure contact with a web server, user client device or combinations thereof 118; computer instructions for instructing the processor to provide a notification to an operator with a display associated with the processor, a user with a client device connected to a network, or combinations thereof wherein the received data exceeds or is less than preset limits 1120; computer instructions for instructing the processor to initiate one or more of a sequence of steps to shut down one or more devices monitoring by the connected devices when the received signals exceed or are less than preset limits 122; computer instructions for instructing the processor to continuously update a user client device with received data from one or more of the connected devices 124; computer instructions for instructing the processor to provide a notification when the processor becomes disconnected from one or more of the connected devices, wherein the notification is provided to a display connected to the processor, to a client device of a user connected through a network, or combinations thereof 126; computer instructions to instruct the processor to generate a report on request concerning the status of the connected device, the overall method employed by the method or combinations thereof 128; and computer instructions for continuing to run the computer, in the event of power failure, from an uninterrupted power supply to shut down each pump and heater of the process and close or open associated valves as required for safety of the process 129.

The computer instructions for instructing the processor to monitor and receive data from a connected device of the process 114 can provide telemetry instructions to allow the processor 92 to speak to one or more of the devices or components of the system.

The computer instructions for instructing the processor to compare the received data to preset limits in the data storage 116 can compare the data acquired by the computer instructions for instructing the processor to monitor and receive data from a connected device of the process 114 to preset limits installed in the data storage 94. The preset limits can include temperature limits for the feedstock stream, volume limits for the reactors, settling vessels, or feedstock tank, flow rates of the feedstock, flow rates of the finished product, or limits associated with other components of the system. For example, the preset flow rate limit for the feedstock stream can be determined by an operator and can be from about 40 gpm to about 75 gpm and entered into the data storage. The computer instructions for instructing the processor to compare the received data to preset limits in the data storage 116 can compare the stored preset limits to acquired data related to the flow rate of the feedstock stream. In one or more embodiments, the processor can take corrective action, such as shutting down pumps if the minimum flow rate is not met. In addition, the processor can sound an alert to ensure the operator is alerted to the deviation from the preset limits, and the operator can take other corrective action.

The computer instructions for instructing the processor to ensure contact with a web server, user client device or combinations thereof 118 can determine if the processor is in communication with the web-server and client device. If the client device or web-server is not in communication with the processor, an alert or other action can be initiated until communication is reestablished.

The computer instructions for instructing the processor to provide a notification to an operator with a display associated with the processor, a user with a client device connected to a network, or combinations thereof wherein the received data exceeds or is less than preset limits 1120 can be used to send a report or notification when a preset limit is exceeded. For example, if the fluid level in one of the settling vessels exceeds a preset limit these computer instructions can send a notification to an operator.

The computer instructions for instructing the processor to initiate one or more of a sequence of steps to shut down one or more devices monitoring by the connected devices when the received signals exceed or are less than preset limits 122 can communicate with the other computer instructions and initiate shut down of the system or one or more components to maintain the acquired data within the preset limits. For example, in the event that a rupture in the feed tank 10 causes the level to be below the preset limit, the processor can shut down the first pump, steam to the heater, and all other pumps in a timely and safe manner.

The computer instructions for instructing the processor to continuously update a user client device with received data from one or more of the connected devices 124 can send reports to the client device. The reports can contain the information related to the acquired data, the operation of the system, the operation of one or more components of the system, the amount of finished oil produced, the amount of interface layers produced, the amount of bottoms, the amount of finished product or combinations thereof.

The computer instructions for instructing the processor to provide a notification when the processor becomes disconnected from one or more of the connected devices, wherein the notification is provided to a display connected to the processor, to a client device of a user connected through a network, or combinations thereof 126 can send alerts or reports if one of the components of the system fails to communicate with the processor.

The computer instructions to instruct the processor to generate a report on request concerning the status of the connected device, the overall system, acquired data, or combinations thereof 128 can receive one or more signals from a connected client device and provide a requested report. Accordingly, the computer instructions to instruct the processor to generate a report on request concerning the status of the connected device, the overall system, acquired data, or combinations thereof 128 can allow an operator to obtain one or more reports in real time.

The computer instructions for continuing to run the processor, in the event of power failure, from an uninterrupted power supply to shut down each pump and heater of the process and close or open associated valves as required for safety of the process 129 can ensure that the processor continues to operate off of a uninterrupted power source if a primary power source is interrupted until the system is shutdown safely. The processor can save all the data and instructions during the power failure, and until the system is shut down.

While these embodiments have been described with emphasis on the embodiments, it should be understood that within the scope of the appended claims, the embodiments might be practiced other than as specifically described herein.

What is claimed is:

1. A computer implemented system for continuously processing used oils comprising:

a. a feedstock tank containing feedstock, wherein the feedstock comprises a used oil;

b. a sparging device disposed in the feedstock tank for mixing the feedstock in the feedstock tank;

c. a level sensor in the feedstock tank for continuously monitoring a level of the feedstock in the feedstock tank;

d. a pump in fluid communication with the feedstock tank for providing a feedstock stream;

e. a first filter in fluid communication with the pump in fluid communication with the feedstock tank;

f. a heater downstream of the first filter and in fluid communication with the first filter;

g. a second filter downstream of the heater;

h. a first flow meter downstream of the feedstock tank for measuring a flow rate of the feedstock stream;

i. a primary nozzle downstream of the first flow meter for providing aqueous sulfuric acid to the feedstock stream;

j. a secondary nozzle downstream of the primary nozzle for providing concentrated sulfuric acid to the feedstock stream;

k. a motionless inline static mixer downstream of the secondary nozzle;

l. a first reactor downstream of the motionless inline static mixer, wherein the first reactor receives a mixed stream from the motionless inline static mixer, and wherein the first reactor separates the mixed stream into a first water layer, a first interface layer, an intermediate oil product layer, and a bottoms layer;

m. a pump in fluid communication with the intermediate oil product layer and an injection nozzle, wherein the injection nozzle is adapted to provide an aromatic solvent release agent from an aromatic solvent release tank to the first intermediate oil product layer;

n. a second inline mixer in fluid communication with the pump in fluid communication with the intermediate oil product layer, wherein the second inline mixer is adapted to blend the solvent release agent with the first intermediate oil product layer to form a blended product;

o. a second reactor in fluid communication with the second inline mixer, wherein a second bottoms layer, a second water layer, a second interface layer, and a finished oil product are formed within the second reactor from the blended product;

p. a water distribution system in fluid communication with the first water layer in the first reactor and the second water layer in the second reactor;

q. an interface tank in fluid communication with the first interface layer in the first reactor and the second interface layer in the second reactor;

r. a disposal in fluid communication with the first bottoms layer in the first reactor and the second bottoms layer in the second reactor;

s. a pump in fluid communication with the finished oil product;

t. a second flow meter in fluid communication with the pump in fluid communication with the finished oil product; and u. a computer processor for receiving signals from the flow meters and level sensors in the tanks, for comparing the received signals to preset values stored in an associated data storage, and for controlling the pumps in the system.

2. The system of claim 1, wherein the heater is a heat exchanger.

3. The system of claim 1, wherein the first filter comprises at least two stages.

4. The system of claim 1, wherein the computer processor provides instructions to inject concentrated sulfuric acid at a ratio of from 2 gallons per 1000 gallons of feedstock to 4 gallons per 1000 gallons of feedstock.

5. The system of claim 1, wherein the computer processor provides instructions to inject the solvent release agent at a ratio of from between 4 gallons per 1000 gallons of feedstock to 7 gallons per 1000 gallons of feedstock.

6. The system of claim 1, wherein the solvent release agent comprises alcohols, ketones, esters, aliphatic solvents, detergents, aromatic solvents, derivatives thereof, or combinations thereof.

7. The system of claim 1, further comprising a third filter disposed between the first filter and the heater.

8. The system of claim 1, further comprising a first settling vessel for receiving the finished oil product from the second flow meter that allows separation of the finished oil product into a waste water and a finished product.

9. The system of claim 8, further comprising a second settling vessel in parallel with the first settling vessel, for receiving the finished oil product from the second flow meter and allowing separation of the finished oil product into a waste water and a finished product, and a pump for pulling the waste water to a waste water tank and a pump for pulling the finished product to the finished product tank.

10. The system of claim 9, wherein each of the settling vessels comprise level sensors in communication with the computer processor which can compare signals from the sensors to preset limits, and when the signals exceed the preset limits, the computer processor shuts down each of the pumps.

11. The system of claim 1, wherein the computer processor is in communication with a network for providing information to a web-server and a client device.

* * * * *